US008893822B2

(12) United States Patent
Trinh et al.

(10) Patent No.: US 8,893,822 B2
(45) **Date of Patent: *Nov. 25, 2014**

(54) APPARATUS AND METHODS FOR REAL TIME COMMUNICATION BETWEEN DRILL BIT AND DRILLING ASSEMBLY

(75) Inventors: Tu Tien Trinh, Houston, TX (US); Eric Sullivan, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 148 days.

This patent is subject to a terminal disclaimer.

(21) Appl. No.: 13/195,098

(22) Filed: Aug. 1, 2011

(65) Prior Publication Data

US 2012/0031670 A1 Feb. 9, 2012

Related U.S. Application Data

(60) Provisional application No. 61/371,550, filed on Aug. 6, 2010.

(51) Int. Cl.

| | |
|---|---|
| ***E21B 47/00*** | (2012.01) |
| ***E21B 17/02*** | (2006.01) |
| ***E21B 10/00*** | (2006.01) |
| ***E21B 47/12*** | (2012.01) |

(52) U.S. Cl.

CPC ..... *E21B 47/12* (2013.01); *E21B 17/028* (2013.01); *E21B 10/00* (2013.01)

USPC ..... 175/50; 175/26; 175/24; 175/40; 324/369; 324/356; 340/853.6; 340/855.1; 367/81; 367/82; 367/83; 367/84; 367/85

(58) Field of Classification Search

CPC ... E21B 17/028; E21B 17/023; E21B 47/011; E21B 47/12; E21B 10/00

USPC ..... 340/853.1, 853.6, 854.9, 855.1, 855.2; 324/369, 356; 175/26, 24, 40, 50; 367/81, 82, 83, 84, 85

See application file for complete search history.

(56) References Cited

U.S. PATENT DOCUMENTS

| | | | | |
|---|---|---|---|---|
| 3,365,007 | A * | 1/1968 | Skipper | 175/61 |
| 5,160,925 | A * | 11/1992 | Dailey et al. | 340/853.3 |
| 6,626,251 | B1 | 9/2003 | Sullivan et al. | |
| 6,698,536 | B2 * | 3/2004 | Moran et al. | 175/57 |

(Continued)

OTHER PUBLICATIONS

Related Application International Search Report and Written Opinion dated Dec. 20, 2011 for International Application No. PCT/US2011/046896.

(Continued)

*Primary Examiner* — Jennifer H Gay
*Assistant Examiner* — George Gray
(74) *Attorney, Agent, or Firm* — Cantor Colburn LLP

(57) ABSTRACT

An apparatus and method of performing a wellbore operation. The apparatus includes a drill bit that has a cavity at an end thereof and a communication device placed in the cavity. The communication device includes a first section and a second section. An outer dimension of the second section is greater than an outer dimension of the first section. The second section includes a conduit configured to allow passage of a conductor from the drill bit to a location outside the drill bit so as to provide a direct connection of the conductor from the drill bit to an element outside the drill bit.

19 Claims, 6 Drawing Sheets

(56) References Cited

U.S. PATENT DOCUMENTS

| | | | | |
|---|---|---|---|---|
| 8,130,117 | B2 * | 3/2012 | Hall et al. | 340/853.1 |
| 2001/0012703 | A1 | 8/2001 | Wurm et al. | |
| 2003/0084716 | A1 | 5/2003 | Patey et al. | |
| 2007/0272442 | A1 * | 11/2007 | Pastusek et al. | 175/40 |
| 2008/0066961 | A1 | 3/2008 | Aivalis et al. | |
| 2010/0118657 | A1 | 5/2010 | Trinh et al. | |

OTHER PUBLICATIONS

International Search Report and Written Opinion dated Jan. 4, 2012 for International Application No. PCT/2011/046895.

* cited by examiner

APPARATUS AND METHODS FOR REAL TIME COMMUNICATION BETWEEN DRILL BIT AND DRILLING ASSEMBLY

CROSS REFERENCES TO RELATED APPLICATIONS

This application claims priority from the U.S. Provisional Patent Application having the Ser. No. 61/371,550 filed Aug. 6, 2010.

BACKGROUND INFORMATION

1. Field of the Disclosure

This disclosure relates generally to drill bits that include sensors for providing measurements and communication of measured and/or processed data to components in a drilling assembly attached to the drill bit.

2. Brief Description of the Related Art

Oil wells (wellbores) are usually drilled with a drill string that includes a tubular member having a drilling assembly (also referred to as the bottomhole assembly or "BHA") with a drill bit attached to the bottom end thereof. The drill bit is rotated to disintegrate the earth formations to drill the wellbore. The BHA includes devices and sensors for providing information about a variety of parameters relating to the drilling operations, behavior of the BHA and formation surrounding the wellbore being drilled (formation parameters). A variety of sensors, such as pressure sensors, inclinometers, sensor gamma ray sensors, etc. are embedded in the drill bit for providing information about various drilling and formation parameters. The data from the bit sensors is often stored in memory devices in the drill bit, which data is retrieved after tripping the drill bit out of the wellbore for further processing and use. It is desirable to transmit the bit sensor data and/or processed data from a circuit in the drill bit to the BHA and/or to the surface while drilling the wellbore, i.e., in real-time because the drill bit does not generally have adequate space for housing electronic circuitry to process large amounts of data. The BHA normally includes processors that can process copious amounts of sensor data and therefore it is economical to process the drill bit data in the BHA. Also, the drill bit is subjected to greater vibrations and thrust forces than certain parts of the BHA, where it is more desirable to locate the processors.

The disclosure provides an apparatus and methods for real-time communication of data and power between the drill bit and another device, such as a BHA, connected to the drill bit.

SUMMARY

An apparatus made according to one embodiment includes a drill bit that has a cavity at an end thereof and a communication device placed in the cavity, wherein the communication device includes a first section and a second section, wherein an outer dimension of the second section is greater than an outer dimension of the first section, and wherein the second section includes a conduit configured to allow passage of a conductor from the drill bit to a location outside the drill bit so as to provide a direct connection of the conductor from the drill bit to an element outside the drill bit.

Examples of certain features of the apparatus disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

For detailed understanding of the present disclosure, references should be made to the following detailed description, taken in conjunction with the accompanying drawings in which like elements have generally been designated with like numerals and wherein.

DESCRIPTION OF THE DISCLOSURE

The present disclosure relates to real-time communication between a drill bit and a device or tool coupled to the drill bit when the drill bit is in use. The present disclosure is susceptible to embodiments of different forms. The drawings show and the written disclosure describes specific embodiments of the present disclosure with the understanding that the disclosure is to be considered an exemplification of the principles of the disclosed herein, and that it is not intended to limit the disclosure to that illustrated and described herein.

Figure 1:
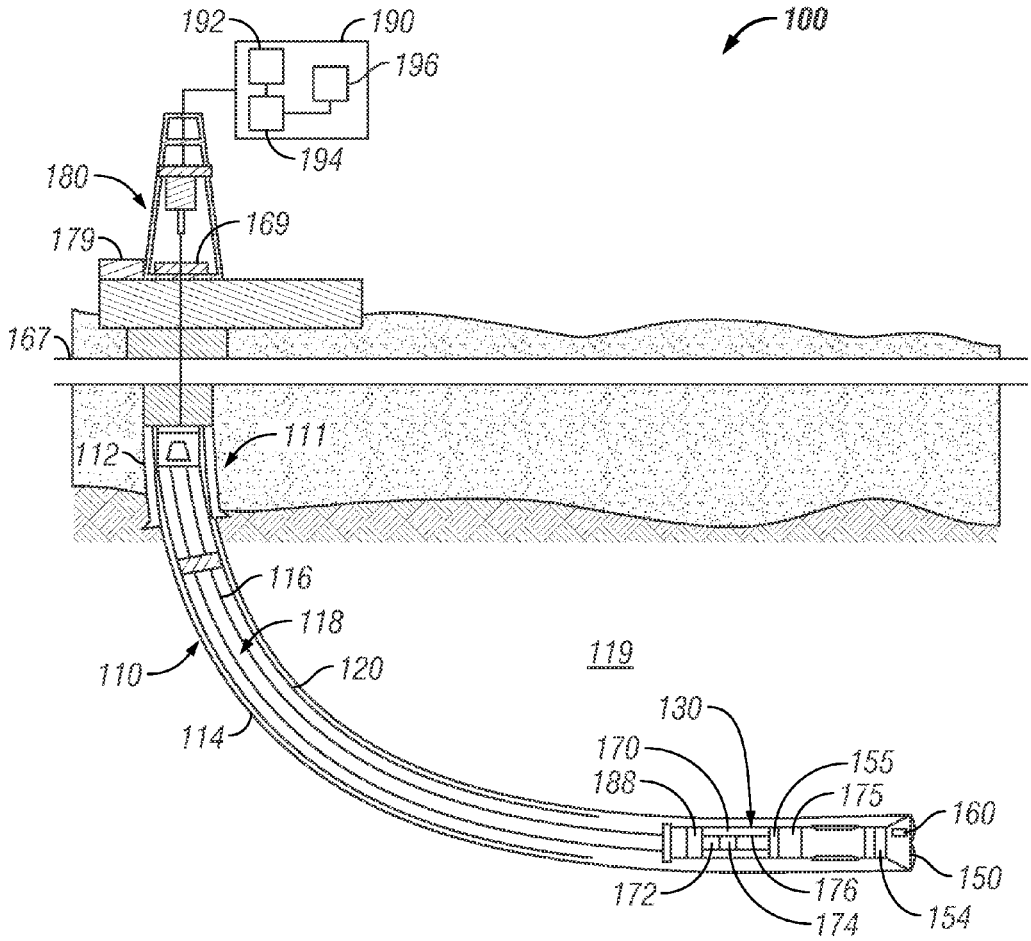
FIG. 1 is a schematic diagram of a drilling system that includes a BHA with a drill bit attached thereto and a communication apparatus between the drill bit and the BHA.

FIG. 1 is a schematic diagram of an exemplary drilling system 100 that may utilize drill bits and data communication devices disclosed herein for use in drilling wellbores. FIG. 1 shows a wellbore 110 that includes an upper section 111 with a casing 112 installed therein and a lower section 114 that is being drilled with a drill string 118. The drill string 118 includes a tubular member 116 that carries a drilling assembly 130 (also referred to as the bottomhole assembly or "BHA") at its bottom end. The tubular member 116 may be made by joining drill pipe sections or it may be a coiled-tubing. A drill bit 150 is attached to the bottom end of the BHA 130 for disintegrating the rock formation to drill the wellbore 110 of a selected diameter in the formation 119. Not shown are devices such as thrusters, stabilizers, centralizers, and devices such as steering units for steering the drilling assembly 130 in a desired direction. The terms wellbore and borehole are used herein as synonyms.

Drill string 118 is shown conveyed into the wellbore 110 from a rig 180 at the surface 167. The exemplary rig 180 shown in FIG. 1 is a land rig for ease of explanation. The apparatus and methods disclosed herein may also be utilized with rigs used for drilling offshore wellbores. A rotary table 169 or a top drive (not shown) coupled to the drill string 118 at the surface may be utilized to rotate the drill string 118 and thus the drilling assembly 130 and the drill bit 150 to drill the wellbore 110. A drilling motor 155 (also referred to as "mud motor") may also be provided to rotate the drill bit. A control unit (or controller) 170 in the BHA 130 may be configured to receive and process data from the sensors 160 in the drill bit 150 and sensors 175 in the drilling assembly 130 and to control selected operations of the various devices and sensors in the drilling assembly 130. The controller 170 may include a processor 172, such as a microprocessor, a data storage device 174 and programs 176 for use by the processor 170 to process the data from the sensors 160 and 175. Also, a controller 190, which may be a computer-based system, may be placed at the surface 167 for receiving and processing data transmitted by the sensors in the drill bit and sensors 175 in the drilling assembly 130 and for controlling selected operations of the various devices and sensors in the drilling assembly 130. The surface controller 190, in one embodiment, may include a processor 192, a data storage device (or a computer-readable medium) 194 for storing data and computer programs 196. The data storage devices 174 and 194 may be any suitable devices, including, but not limited to, a read-only memory (ROM), a random-access memory (RAM), a flash memory, a magnetic tape, a hard disc and an optical disk. To drill a wellbore, a drilling fluid from a source 179 is pumped under pressure into the tubular member 116. A telemetry unit 188 in the BHA provides two-way communication between the BHA and the surface controller 190. During drilling, the drilling fluid discharges at the bottom of the drill bit 150 and returns to the surface via the annular space (also referred as the "annulus") between the drill string 118 and the inside wall of the wellbore 110.

Still referring to FIG. 1, drill bits, such as drill bit 150, commonly include a threaded pin connection at its top end that is connected to a box end at the bottom of the BHA 130. The box end includes internal threads that complement the threads on the drill bit pin connection. Mating the box end with the pin end provides a fixed connection between the BHA and the drill bit 150. Such a connection is not conducive to providing a direct path for conductors from the drill bit 150 to the BHA 130. Therefore, electrical communication between the drill bit 150 and the data bus in the BHA 130 are either not provided or in some cases, electrical coupling rings are used at the box end and at a neck portion of the pin connection, which coupling rings come in contact with each other when the box end mates with the pin end, thereby providing an electrical path between the drill bit 150 and the BHA 130. In the configuration shown in FIG. 1, a direct data and power connection between the drill bit 150 and the BHA 130 is provided via a communication link 154. The details of an exemplary communication link 154 are described in reference to FIGS. 4-6.

Figure 2:
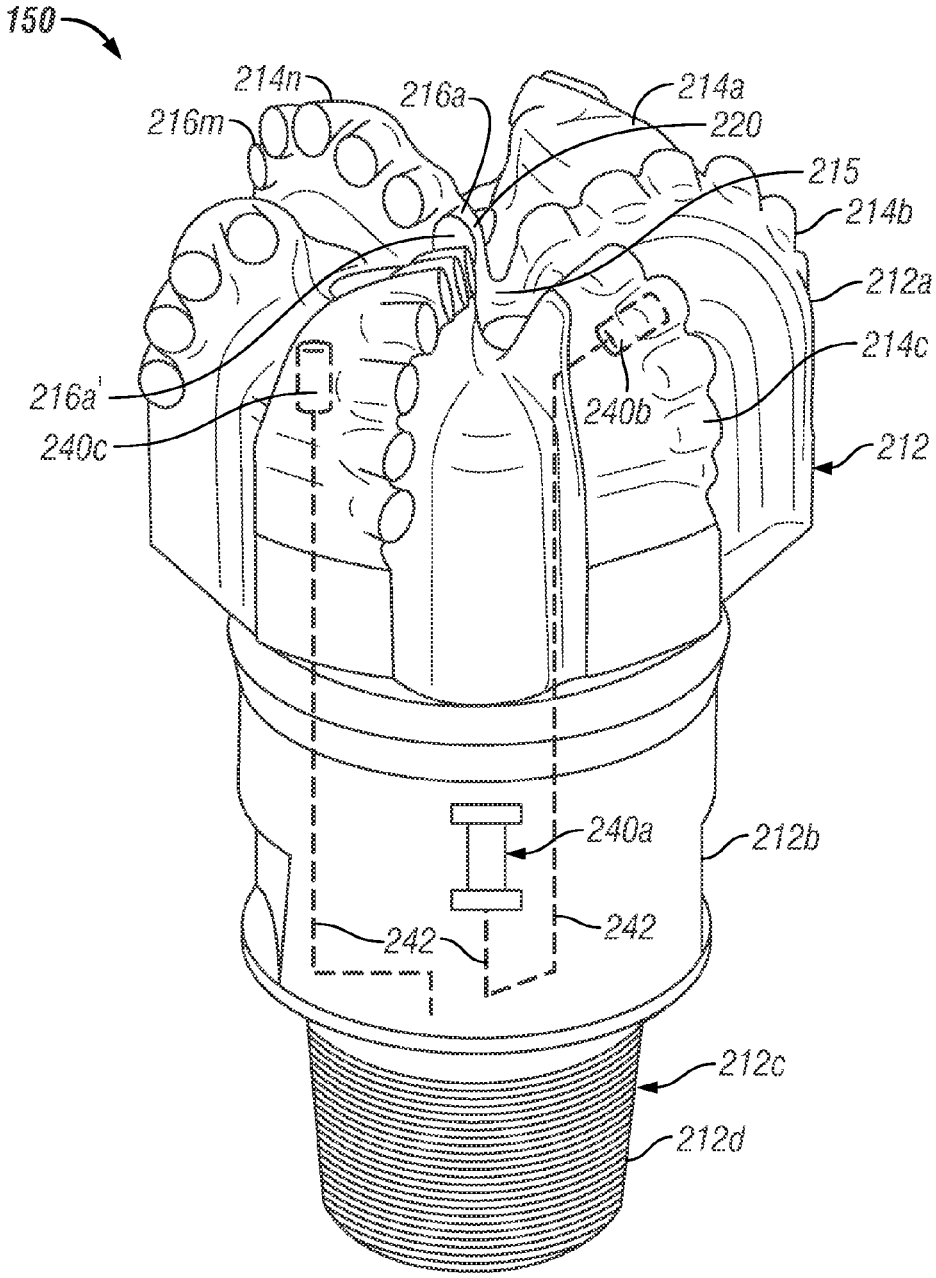
FIG. 2 is an isometric view of an exemplary drill bit showing placement of sensors in the drill bit and corresponding communication links to a neck of the drill bit.

FIG. 2 shows a perspective view of an exemplary drill bit 150. The drill bit 150 shown is a PDC (polycrystalline diamond compact) drill bit for the purposes of explaining the concepts described herein. However, any other type of drill bit may be utilized for the purpose of this disclosure. The drill bit 150 is shown to include a drill bit body 212 comprising a crown 212*a* and a shank 212*b*. The crown 212*a* includes a number of blade profiles (or profiles) 214*a*, 214*b*, . . . 214*n*. A number of cutters are placed along each profile. For example, profile 214*n* is shown to contain cutters 216*a*-216*m*. All profiles are shown to terminate at the bottom 215 of the drill bit 150. Each cutter has a cutting surface or cutting element, such as element 216*a*' of cutter 216*a*, that engages the rock formation when the drill bit 150 is rotated during drilling of the wellbore. The drill bit 150 includes a neck or pin connection 212*c* having external threads 212*d*. The BHA connects to the pin section 212*c* via a box section having internal threads compliant with the threads 212*d*. One or more sensors, such as sensors 240*a*, 2420, 240*c*, placed in the drill bit body generate measurement signals that may be processed by circuits in the drill bit 150 and transmitted to the BHA 130 or transmitted to the BHA by the direct communication link 154 (FIG. 1) as described in more detail in reference to FIGS. 3-6.

Figure 3:
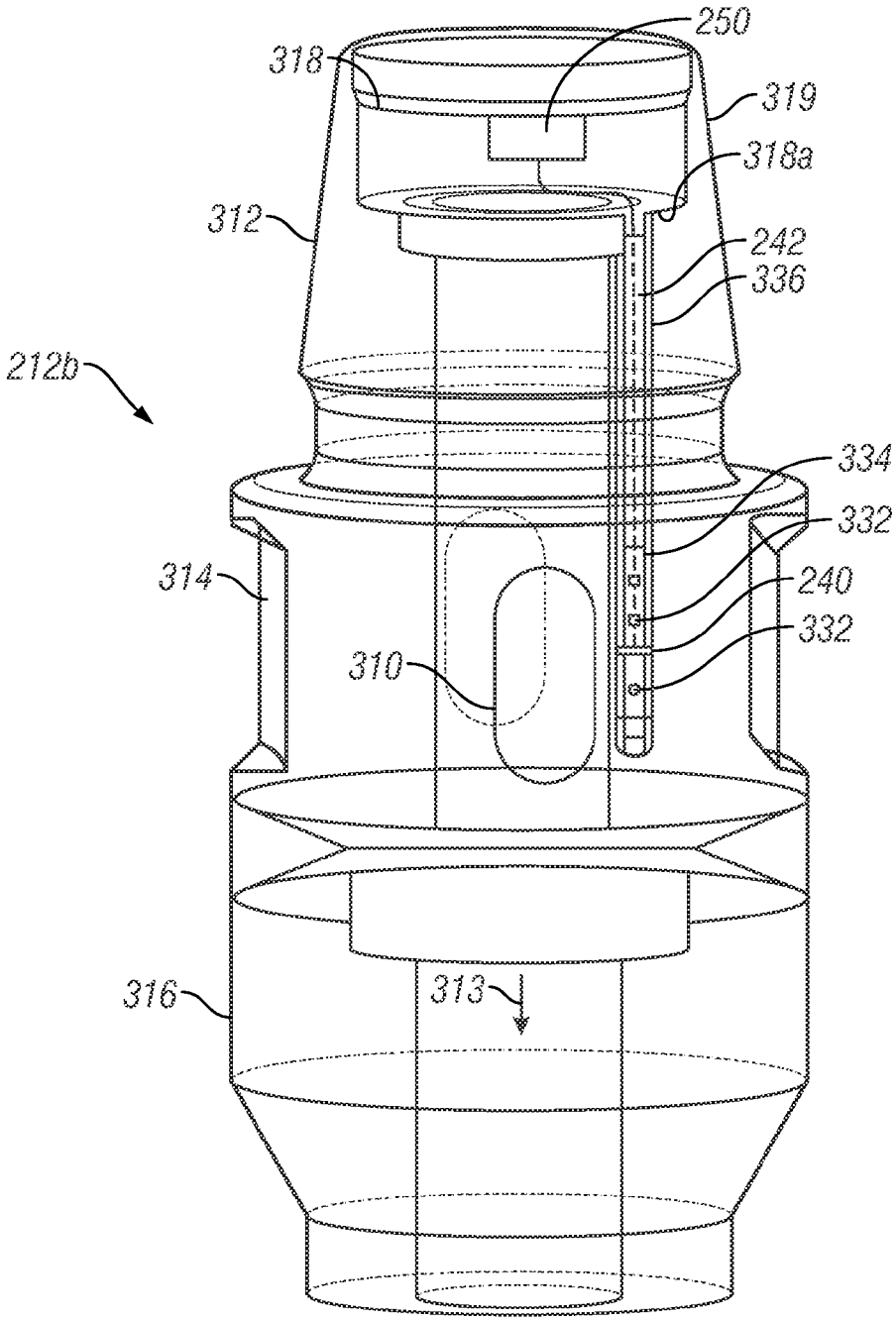
FIG. 3 is an isometric line diagram of a shank of the drill bit of FIG. 2 showing placement of electronic circuit in a neck portion of the shank for processing drill bit sensor signals.

FIG. 3 shows a transparent perspective view of the shank 212*b* and the pin section 212*c* of the drill bit 150 shown in FIG. 2. The shank 212*b* includes a bore 310 therethrough for supplying drilling fluid 313 to the crown 212*a* (FIG. 2) of the drill bit 150. The upper end 312 of the neck section 212*c* includes a recess section 318 for housing therein the communication link 154 (FIG. 1) and electronics 250 for processing signals from the various sensors 240*a*, 240*b*, 240*c* (collectively sensors 240) in the drill bit 150. Threads 319 on the neck section 312 connect the drill bit 150 to the drilling assembly 130 (FIG. 1) as described before. Power to and measurement signals from the sensors 240 may be communicated between the recess 318 via conductors (electrical, fiber optic, etc.) 242 placed in a bore 332 in the shank 212*b* between the sensors 240 and the bottom 318*a* of the recess 318.

Figure 4:
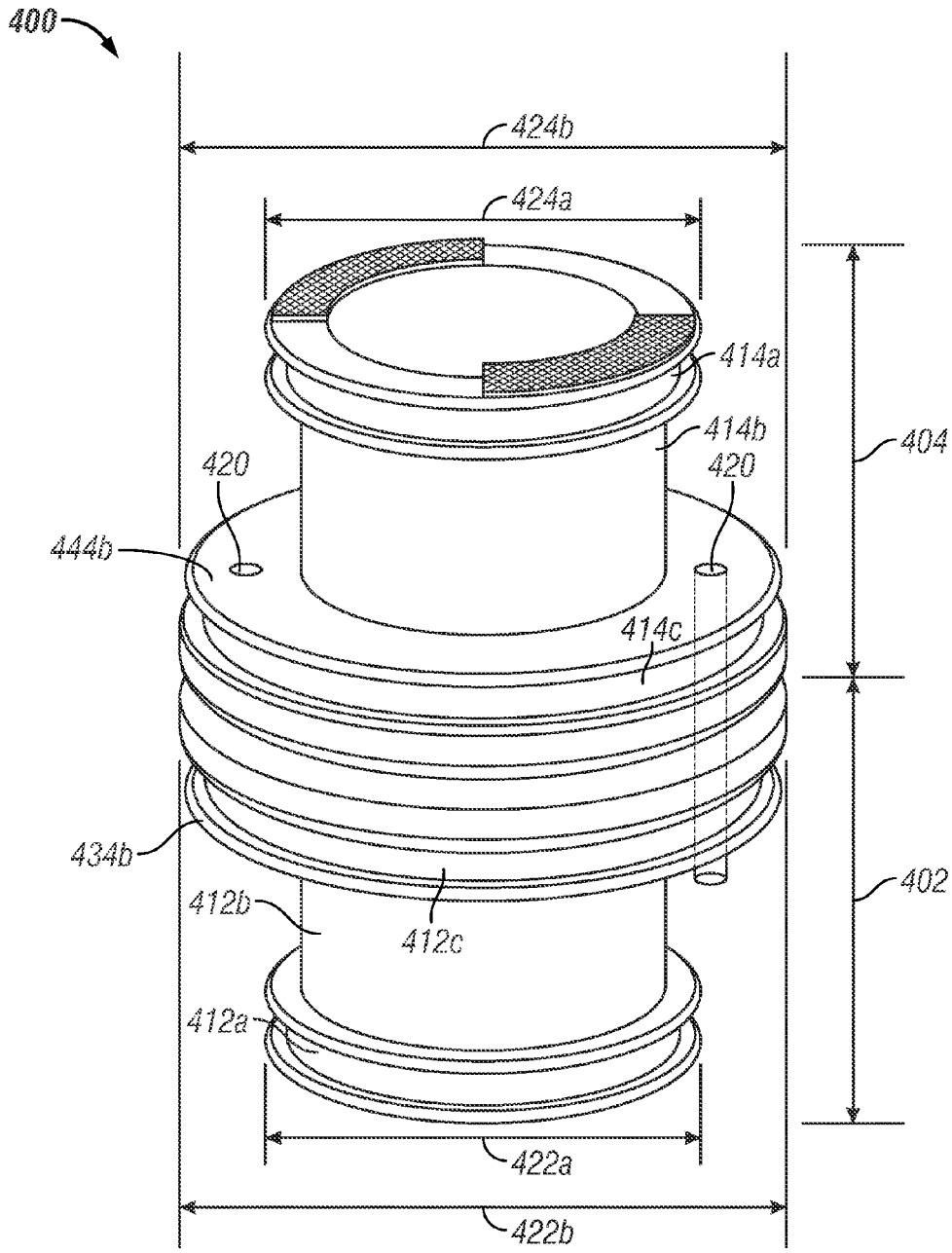
FIG. 4 is an isometric view of a communication link configured to house electronic circuitry and provide a passage for direct data and power connection between the drill bit and BHA.

FIG. 4 is a perspective view of an exemplary communication device or a communication link 400 configured to provide direct communication link between two connecting members, including, but not limited to, drill bit 150 and BHA 130 (FIG. 1) and adjacent drill pipe sections. The communication link 400 shown is configured as a double spool that includes a lower section 402 and an upper section 404. In one aspect, the lower and upper sections 402, 404 may be mirror images of each other, as shown in FIG. 4. The section 402 is shown to include a lower recess or first recess section 412*a*, a middle recess or second recess section 412*b* and an upper recess or third recess section 412*c*. Similarly, the upper section 404 includes a lower recess section 414*a*, a middle recess section 414*b* and an upper recess section 414*c*. In the embodiment shown, the middle recess sections 412*b* and 414*b* abut against each other and may be made of the same or different dimensions. In one aspect, the outer dimension or diameter 422*b* of the middle recess section 412*b* is greater than the outer diameter 422*a* of the lower recess section 412*a*, while the outer diameter 424*b* of the middle recess section 414*b* is greater than the outer diameter 424*a* of the lower recess section 414*a*. The middle recess sections 412*b* and 414*b*, in one embodiment, are configured to contain electrical circuits and processors configured to process signals generated by the sensors 240 in the drill bit 150 (FIGS. 2 and 3). The recess sections 412*a*, 412*c*, 414*a* and 414*c* are configured to contain separate seals, such as o-rings configured to fluidly seal the communication link 400 at one end from a first member, such as the drill bit 150, and at the second end from a connecting member, such as a box end at the end of the BHA 130 (FIG. 1). One or more bores, such as bore 420, may be formed from a flange surface 434*b* of the middle recess section 412*b* to a flange surface 444*b* of the middle recess section 414*b*. The bores 420 are of a size suitable to run conductors, such as electrical conductors and optical fibers therethrough. The location of the bores 420, in one configuration, is outside the diameters 422*a* and 424*a* so that conductors can be run directly from below the lower recess section 412*a* to the bore 420 and then from the bore 420 to a location above the lower recess 414*a*, as described in more detail in reference to FIG. 5. In an embodiment, a bottom facet 435 of section 402 has an anti-rotational feature that would keep the communication link 400 from rotating when the box end 562 of tool 560 screwed onto pin section 502. An exemplary anti-rotational feature may be alternating surface heights of the bottom facet 435 (such as that shown for the surface across diameter 424*a*) and/or non-rounded (e.g., elliptical, hex, rectangular) geometry of the bottom facet 435. In the example, the spool section 402 with the anti-rotational feature is connected to the bit first, the box end of the tool is then connected to the pin of the bit, and concurrently connected or mated with the spool.

Figure 5:
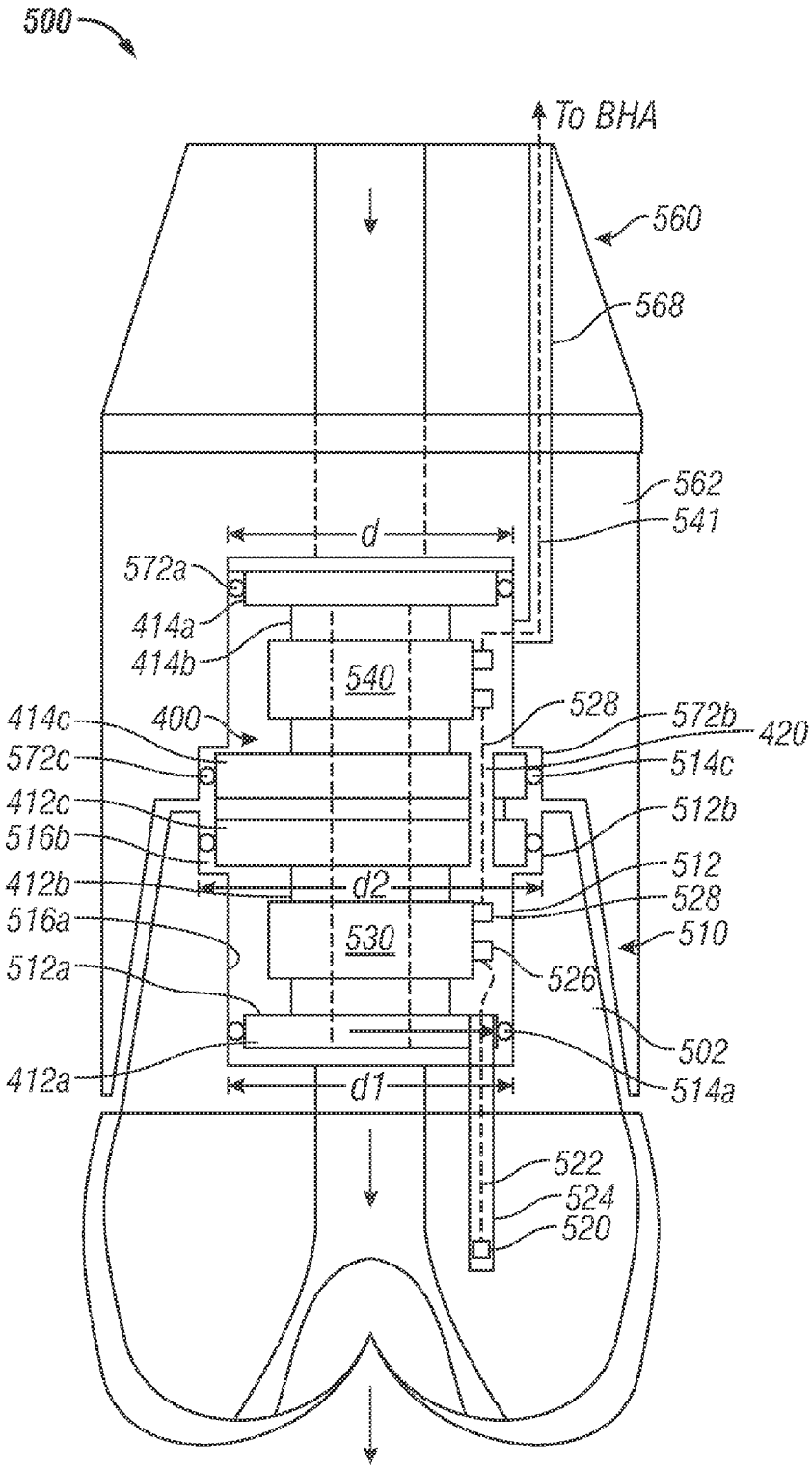
FIG. 5 is a line diagram showing the communication link of FIG. 4 placed between a drill bit and another tool, such as a BHA, connected to the drill bit, according to one embodiment of the disclosure.

FIG. 5 shows an assembly 500, wherein a pin section 502 of a drill bit 510 is coupled to a box end 562 of a tool 560, with one section 402 of a communication link 400 placed within the pin section 502 of the drill bit 510 and the other section 402*b* placed within the box end 562 of the tool 560 to provide a direct communication link between the drill bit 510 and the tool 560. A communication link or device, including, but not limited to device 400, placed between adjoining members configured to provide a direct communication link between the adjoining members may be referred to as a "communication sub" or "sub." The adjoining members may be any suitable members, including, but not limited to, two tubular members, such as drill pipe sections, a drill bit and a BHA, a BHA and a tubular, and two downhole tools.

In the configuration shown in FIG. 5, the pin section 502 is shown to include a recess 512 having a lower or smaller recess 512*a* of diameter d1 and an upper or larger recess 512*b* of diameter d2. The box end 562 includes the same recess structure as the pin section 502. As shown, the box end 562 includes a recess 572 having a lower or smaller recess 572*a* of diameter d1 and an upper or larger recess 572*b* of diameter d2. To form the assembly 500, a sealing member 514*a* is placed in the recess 412*a* and a sealing member 514*c* is placed in the recess 412*c* of the communication link 400. The lower section 402 of the communication link 400 is then placed inside the recess 512*a* so that the seal 514*a* seals the recess 412*a* against the wall 516*a* of the recess 512*a* and the seal 514*c* seals the recess 412*c* against the inside wall 516*b* of the recess 512*b*. This ensures that the lower section 402 of the communication sub 400 is secured airtight in the pin connection.

Still referring to FIG. 5, before placing the communication link 400 in the pin section 502, conductors 522 (electrical wires, optical fibers, etc.) are run from the sensors 520 in the drill bit 510 to the cavity 512 in the pin section via a conduit or cavity 524 in the drill bit 510. A connector 526 may be used to connect the conductors 522 to a circuit 530 placed in or around the middle recess 410*b* of the section 402 of the communication link 400. Conductors 528 from the circuit 530 are run through the bore 420 in the communication link 400 so that conductors 528 are available for connection to the circuits 540 in the recess section 414*b* and/or the BHA 130 as described below. Once the conductors 522 have been run through the bore 420, the lower section 402 of the communication link 400 may be placed in cavity 512. The conductors 528 are then connected to the circuit 540. The conductors 541 from the circuit are then run through the bore or conduit 568 in the box section 562 to the BHA. Alternatively or in addition to conductors 522 from the drill bit 510 may be run to the BHA 130 via the bore 420 and bore 568. Such configurations provide direct connection of the conductors 522, 528 and 541 from the drill bit 510 to the BHA. The conductors 522, 528 and 541, as the case may be, can carry large amounts of data to a suitable circuit and processor in the BHA. Also, conductors can be run from the BHA 130 to the circuits 530, 540 and sensors 520 to provide power and to provide two-way communication with such elements. Direct communication between the drill bit 510 and the BHA 130 eliminates the need for batteries in the drill bit and the use of delicate electronic circuits, including microprocessors, because such elements can be placed in the BHA sections where more space is available and which sections may be less susceptible to vibrations compared to the drill bit. Once all the conductors have been run as desired, the box end 562 of the tool 560 is then screwed onto the pin section 502. Seals 572*a* and 572*c* respectively provide airtight connections between the box end 562 and the lower recess 414*a* and the upper recess 414*c*.

Figure 6:
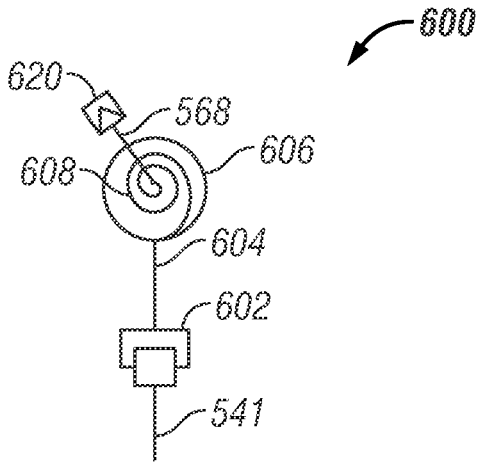
FIG. 6 shows an auto-retractable device that may be utilized in the communication device for connecting conductors between the drill bit and another device, such as the BHA.

FIG. 6 shows an exemplary auto-retrievable device 600 that may be used to connect the conductors 541 from the communication link 400 to conductors that run to the BHA 130. In one aspect, the auto-retrievable device 600 includes a connector 602 that is connected to the conductors 541. A conductor 604, connected to a storage spool 606 that includes a retraction device 608, is wound around the recess section 414*b* in a manner that when the box end 562 is screwed on to the pin section 502, the conductor 604 will be retracted into the spool 606. The conductors to and from the BHA 130 are connected to a connector 620.

The foregoing description is directed to particular embodiments for the purpose of illustration and explanation. It will be apparent, however, to persons skilled in the art that many modifications and changes to the embodiments set forth above may be made without departing from the scope and spirit of the concepts and embodiments disclosed herein. It is intended that the following claims be interpreted to embrace all such modifications and changes.

The invention claimed is:

1. An apparatus for use in a wellbore, comprising:

a drill bit;

a tool attached to the drill bit, wherein a cavity is formed between the drill bit and the tool; and a communication device in the cavity, the communication device including a first section having a flange surface and a second section have a flange surface and a bore through the flange surface of the first section and the flange surface of the second section, offset from a center of the communication device that allows passage of a conductor from the drill bit to the tool to provide direct communication between the drill bit and the tool.

2. The apparatus of claim 1, wherein the cavity comprises a first cavity in the drill bit and second cavity in the tool.

3. The apparatus of claim 2, wherein the first section is placed in the first cavity in the drill bit and the second section placed is in the second cavity in the tool.

4. The apparatus of claim 2, wherein the first cavity is in a pin section of the drill bit and the second cavity is in a box section of the tool.

5. The apparatus of claim 3, wherein an outer dimension of the second section is greater than an outer dimension of the first section and wherein the bore is formed in the second section.

6. The apparatus of claim 3, further comprising a pressure seal between the first cavity in the drill bit and the communication device and a pressure seal between the second cavity in the tool and the communication device.

7. The apparatus of claim 3, wherein the communication device further includes a third section placed in the second cavity in the tool and wherein the first section, second section and third section form a double spool configured to provide a pressure tight first cavity and a pressure tight second cavity.

8. The apparatus of claim 3 further comprising a first circuit in the first section of the communication device configured to process signals from a sensor in the drill bit and wherein the conductor is coupled to the first circuit in the first section and a second circuit in the second section.

9. The apparatus of claim 1 further comprising a sensor in the drill bit that provides signals relating to a parameter of interest when the drill bit is used to drill a wellbore.

10. The apparatus of claim 1 further comprising a retrievable device connected to the conductor passing through the bore, wherein the retrievable device is configured to enable the tool to be rotatably attached to the drill bit.

11. A method of performing a wellbore operation, comprising:

coupling a drill bit having a first cavity at an upper section of the drill bit to a tool having a second cavity at a lower end of the tool to form a common cavity between the drill bit and the tool; and placing a communication device in the common cavity, the communication device including a first section having a flange surface and a second section have a flange surface and a bore through the flange surface of the first section and the flange surface of the second section, offset from a center of the communication device that enables passage of a conductor between the drill bit and the tool to provide direct communication between the drill bit and the tool.

12. The method of claim 11, wherein the first section is placed in the first cavity in the drill bit and the second section is placed in the first cavity in the drill bit and the second cavity in the tool.

13. The method of claim 12, wherein an outer dimension of the second section is greater than an outer dimension of the first section and wherein the bore is formed in the second section.

14. The method of claim 13 further comprising providing a pressure seal between the first cavity in the drill bit and the communication device and a pressure seal between the second cavity in the tool and the communication device.

15. The method of claim 13, wherein the communication device further includes a third section placed in the second cavity in the tool and wherein the first section, second section and third section form a double spool configured to provide the pressure seal between the first cavity and the drill bit and the communication device and the pressure seal between the second cavity in the tool and the communication device.

16. The method of claim 11 further comprising providing a sensor in the drill bit that provides signals relating to a parameter of interest when the drill bit is used to drill a wellbore.

17. The method of claim 12 further comprising providing a first circuit in the first section configured to process signals from a sensor in the drill bit and coupling the conductor to the first circuit in the first section and a second circuit in the tool.

18. The method of claim 11, wherein the first cavity is in a pin section of the drill bit and the second section is in a box section of the tool.

19. The method of claim 11 further comprising connecting a device to the conductor passing through the bore configured to enable the tool to connect to the drill bit by rotating the tool onto the drill bit.

* * * * *